US005567893A

United States Patent [19]

Kun

[11] Patent Number: 5,567,893

[45] Date of Patent: Oct. 22, 1996

[54] SHOULDER REST FOR VIOLIN OR LIKE INSTRUMENT

[76] Inventor: Michael Kun, R.R. 1,, Oxford Mills, Ontario, Canada, K0J 1J0

[21] Appl. No.: 551,139

[22] Filed: Oct. 31, 1995

[51] Int. Cl.[6] ..... G10D 1/02

[52] U.S. Cl. ..... 84/280

[58] Field of Search ..... 84/278, 280

[56] References Cited

U.S. PATENT DOCUMENTS

| | | | |
|---|---|---|---|
| 3,631,754 | 1/1972 | Kun | 84/280 |
| 3,728,928 | 4/1973 | Looser et al. | 84/280 |
| 4,386,548 | 6/1983 | Wolf | 84/280 |
| 5,270,474 | 12/1993 | Kun | 84/280 |

*Primary Examiner*—Patrick J. Stanzione

*Attorney, Agent, or Firm*—Jones, Tullar & Cooper, P.C.

[57] ABSTRACT

A shoulder rest for an instrument such as a violin or viola, comprising an elongated support suitable for resting on a user's shoulder, and an attachment device adjacent each end of the support for attachment to the instrument with the support spaced away from the back of the instrument. The attachment devices each include a base part upstanding from the support and having a bearing generally aligned with an adjacent end of the support, a pedestal connected to the base part by a shaft rotatable within the bearing, and a clamping member carried by the pedestal and terminating in recesses engageable with a back portion of the instrument. The invention provides torsion springs acting between the pedestals and the base parts so that angular displacement of the support relative to the clamping members is resisted by the springs.

7 Claims, 2 Drawing Sheets

SHOULDER REST FOR VIOLIN OR LIKE INSTRUMENT

BACKGROUND OF THE INVENTION

1. Field of the Invention

The present invention relates to shoulder rests for use with violins, violas, or like instruments.

2. Prior Art

Shoulder rests for violins and like instruments are known which provide a padded support spaced from the back of the instrument, with the spacing being adjustable. Such rests allow the user easily to position the instrument at the most comfortable playing position, irrespective of the build of the user. Prior patents showing such rests are shown in U.S. Pat. Nos. 3,631,754 and 5,270,474, both to Joseph Kun.

Both of these prior patents show shoulder rests comprising an elongated support suitable for resting on a user's shoulder, and clamping members upstanding from each end of the support for clamping to a back portion of the instrument. Each clamping member is associated with adjustment means for varying the spacing between the instrument back and the support, as well as for varying the longitudinal inclination of the support relative to the instrument back. Also, in each case means are provided for varying the side or lateral inclination between the support and the instrument back. In the '754 patent, the latter means include rivets providing pivots connecting an upper part of the clamping means to a lower part fixed to the support. In the '474 patent pivot means are also provided, and are associated with stop means to limit the angle of movement.

SUMMARY OF THE INVENTION

I have found it to be an advantage in shoulder rests of this kind that there be some ability to alter the angle of the instrument relative to the shoulder during playing, although the support must be reasonably firm so as not to wobble. For good results, it is advantageous for the lateral inclination of the support to be controlled by spring means. This can allow the rest automatically to adjust to a comfortable playing position, while also providing adequate stability.

In accordance with the present invention, a shoulder rest for violins or like instruments comprises an elongated support suitable for resting on a user's shoulder, and attachment means adjacent each end of the support for attaching to the instrument with the support spaced away from the back of the instrument, wherein each of the attachment means comprises:

- a base part upstanding from the support and having a bearing generally aligned with an adjacent end portion of the support,
- a pedestal connected to the base part by a shaft rotatable within said bearing, and
- a clamping member carried by the pedestal and terminating in means engageable with a back portion of the instrument,
- and wherein spring means is provided acting between at least one of said pedestals and the associated base part so that angular displacement of the support relative to the clamping member is resisted by the spring means.

Preferably, the spring means is a torsion spring having an outer end connected to the shaft, and having a second, inner, end, and the base part includes retaining means for non-rotatably holding the inner end. The bearing may be a bore within the base part which also contains and conceals the spring.

Preferably, the base part is longitudinally adjustable relative to the support. Preferably also, both of the attachment means are identical insofar as they both comprise a base part, a pedestal and a clamping member, and a torsion spring, as defined.

BRIEF DESCRIPTION OF THE DRAWINGS

A preferred embodiment of the invention will now be described by way of example with reference to the accompanying drawings, in which.

DETAILED DESCRIPTION

Figure 1:
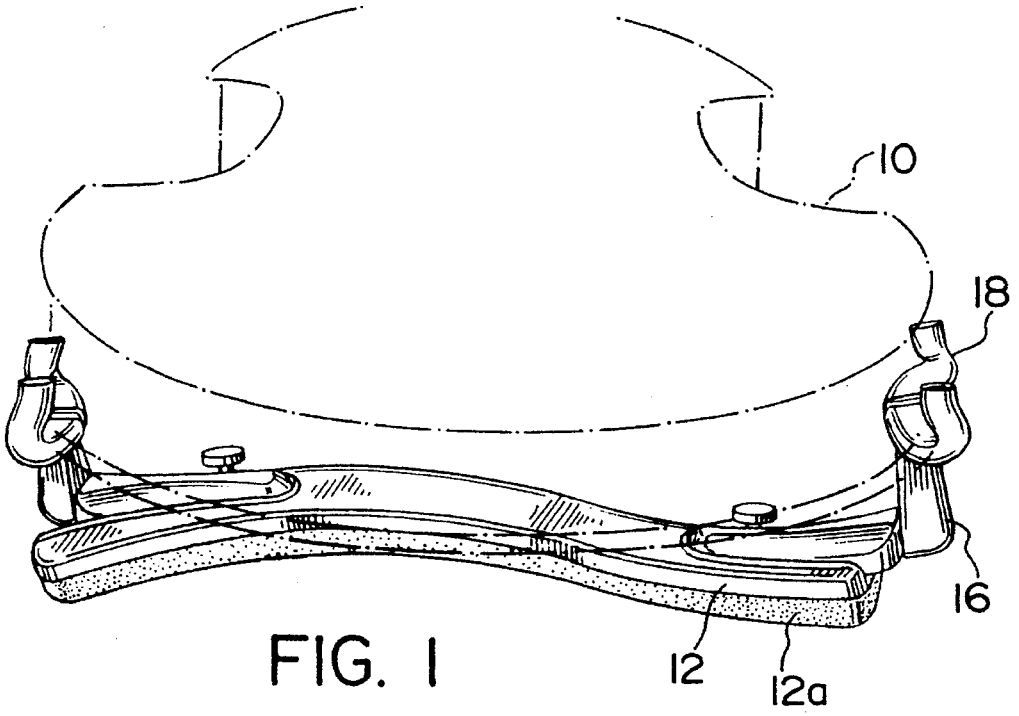
FIG. 1 is a perspective view of the rest as attached to a violin, which is shown in broken lines.

FIG. 1 shows a general view of the rest as attached to a violin 10. Basically, the rest includes an elongated support 12, having at each end attachment means comprising a base part 14 in which is mounted a pedestal 16, and a clamping member 18 carried by the pedestal and having arms 19 with spaced apart recesses **19*a*** which engage the slightly protruding edges of the back of the violin.

The elongated support 12 is formed of material having some flexibility to allow a user to bend it into the best possible shape to conform with the user's shoulder. The lower side of the support is padded with foam rubber **12*a***.

Figure 2:
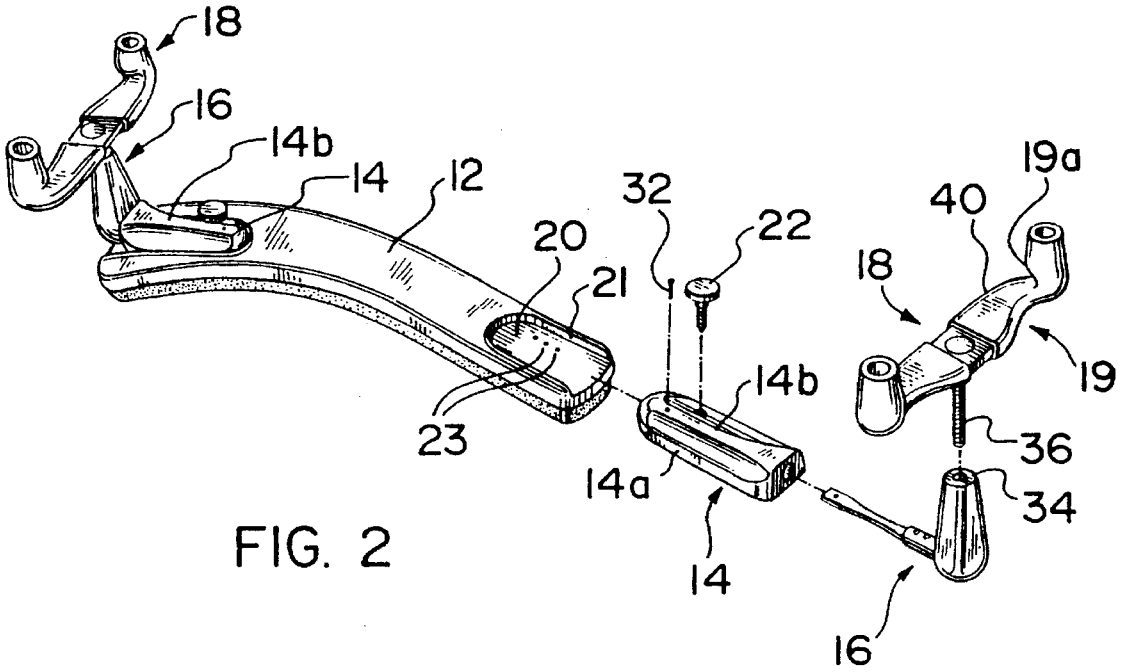
FIG. 2 is a further perspective view of the rest, partially disassembled.
Figure 3:
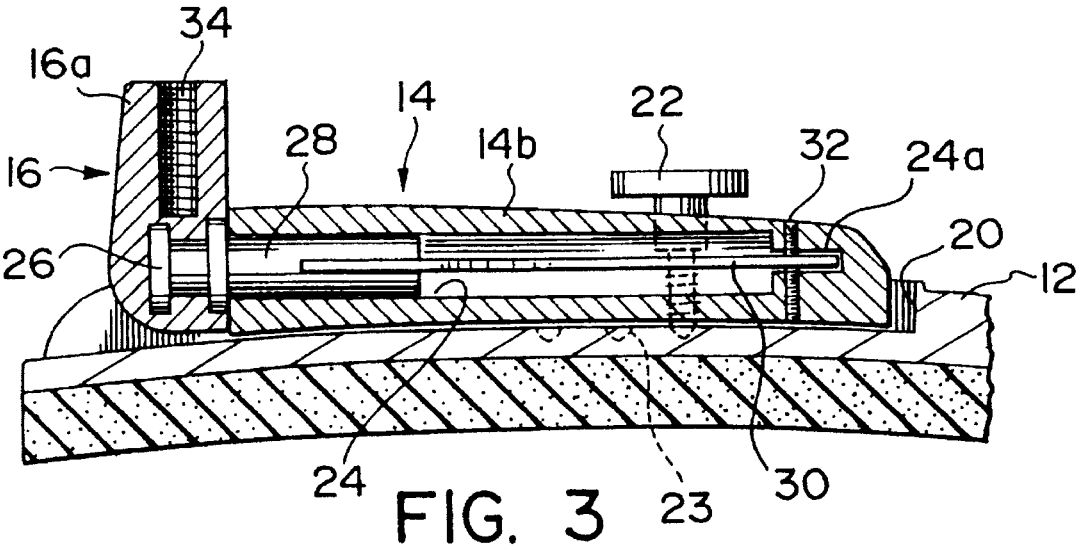
FIG. 3 is a longitudinal section through an end portion of the rest.
Figure 5:
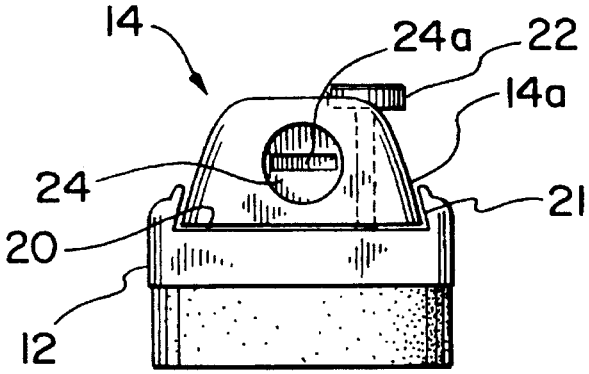
FIG. 5 is a view on an outer end portion of the rest with a pedestal part removed.

As shown in FIGS. 2 and 5, at each end of the support a recess 20 is provided having parallel undercut sidewalls 21 which receive and retain interfitting edges **14*a* of the base part 14. These sidewalls thus provide parallel guide means in which the base part is slidable, these being roughly aligned with the adjacent end portion of the support. The base part has a set screw 22 with an inner end engageable in detents 23 in the bottom of the recess 20 to allow the longitudinal position of the base part to be adjusted to different widths of instruments. The base part has a raised longitudinal rib 14*b*, and in longitudinal section slopes down smoothly towards the upper surface of the support 12. The rib portion overlies a bore 24 extending generally longitudinally of the support 12, and, as shown in FIG. 3, this bore terminates in a flat sided slot 24*a*. The alignment of the parts is such that the bores 24** of the two base parts are generally aligned. The base part may be molded of plastic.

Figure 4:
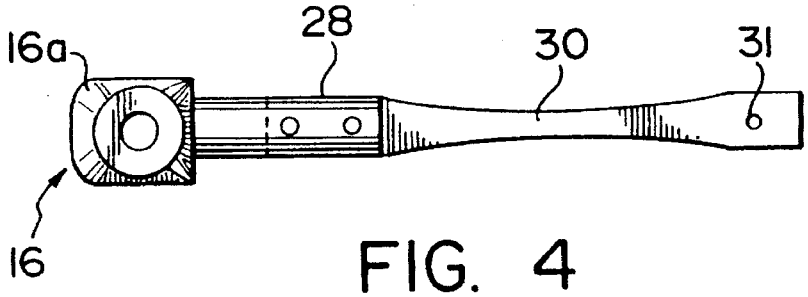
FIG. 4 is a top view of one component of the rest.

FIGS. 2–4 show details of the pedestal 16 which is mounted in the base part. The main part of the pedestal **16*a* is molded of plastics material, this molded part surrounding an enlarged end part 24 integral with a shaft 28. The inner end of this shaft has a slot in which is soldered an elongated strip of spring steel 30 providing a torsion spring. As seen in FIG. 4, the strip 30 is waisted by having its sides ground away at the center, this being a convenient way of adjusting the torsional resistance of the spring. The inner end of the spring 30 has a small transverse hole 31, and this receives a small set screw 32 which, along with the slot 24*a*, non-rotatably retains the inner end of the spring. Thus, the pedestal can be mounted in the base part by inserting the spring 30 and shaft 28 into the bore 24, and securing the spring with screw 32. When the parts are assembled, each bore 24 provides a bearing for one of the shafts 28 which can rotate with the pedestals when the instrument tends to incline laterally relative to the support 12, with springs 30** providing a biassing force urging the pedestal to an upright, neutral position.

The pedestal 16 has an upstanding part 16*a* provided with a threaded bore 34 which receives a threaded shaft 36 of the clamping member carrying clamping arms 19; this threaded connection provides for adjustment of the spacing between the support 12 and the instrument back, as well as the longitudinal inclination of the support. The clamping arms 19 may be similar to those of U.S. Pat. No. 5,270,474 referred to above, with recesses 19*a* which are cushioned by plastic sleeves 40.

In use, the clamping arms 19 are adjusted to the required height by rotation to adjust the screw 34, and the base parts 14 are adjusted longitudinally in the recesses 20 to suit the dimensions of the instrument, and are fixed by set screws 22, with the clamping arms in place on the instrument. The rest thus attached provides reasonably stable holding of the instrument, while the torsion springs 30 provide some adjustability of the lateral inclination of the instrument during playing. It may be noted that the spring is hidden in use, and does not detract from the generally smooth appearance of the rest.

Instead of using separate set screws 22 and 32 for the base part and the spring, a single screw could be used to perform both of these functions.

It will further be apparent that it is not essential for both of the attachment means to be provided with springs; if the support 12 is suitably stiff, a spring at one end only may be sufficient.

I claim:

1. A shoulder rest for an instrument such as a violin or viola, comprising as elongated support suitable for resting on a user's shoulder, and attachment means adjacent each end of the support for attachment to the instrument with the support spaced away from the back of the instrument, wherein each of said attachment means comprises:

a base part upstanding from said support and having a bearing with an axis generally aligned with an adjacent end of said support, a pedestal connected to said base part by a shaft rotatable within said bearing, and a clamping member carried by said pedestal and terminating in means engageable with a back portion of said instrument, and wherein spring means is provided acting between at least one pedestal and its associated base part so that angular displacement of said support relative to said clamping member about said axis is resisted by said spring means.

2. A shoulder rest according to claim 1, wherein said spring means is a torsion spring, and wherein said bearing is part of a bore in said base part which contains said torsion spring.

3. A shoulder rest according to claim 1, wherein said base part is longitudinally adjustable relative to said support.

4. A shoulder rest according to claim 1, wherein both of said attachment means are identical insofar as they each comprise spring means acting between the pedestal and its associated base part.

5. A shoulder rest for an instrument such as a violin or viola, comprising an elongated support suitable for resting on a user's shoulder, and attachment means adjacent each end of the support for attachment to the instrument with the support spaced away from the back of the instrument, wherein at least one of said attachment means comprises:

parallel guide means at one end of said support;

a base part movable in said guide means for longitudinal adjustment relative to said guide means, said base part having means for fixing the position of the base part relative to said support, said base part having a bore generally aligned with the support;

a pedestal connected to said base part by a shaft rotatable within said bore, and a clamping member carried by said pedestal and terminating in means engageable with a back portion of said instrument, and wherein said shaft is fixed to the outer end of a torsion spring which spring has a second, inner, end non-rotatably held by the base part, whereby angular displacement of said support relative to said clamping member is resisted by said torsion spring.

6. A shoulder rest according to claim 5, wherein said spring is totally concealed within said base part.

7. A shoulder rest according to claim 5, wherein said means for fixing the position of the base part is a screw which also provides holding means for the inner end of said spring.

* * * * *